US006105973A

United States Patent [19]

Butler et al.

[11] Patent Number: 6,105,973

[45] Date of Patent: Aug. 22, 2000

[54] COMPOSITE GASKET

[75] Inventors: Donald James Butler, Pickering; Murray Charles Jefferies, Scarborough; Henrique Manuel Costa Dos Reis, Toronto, all of Canada

[73] Assignee: Tremco Ltd., Toronto, Canada

[21] Appl. No.: 08/119,245

[22] PCT Filed: Apr. 2, 1991

[86] PCT No.: PCT/CA91/00107

§ 371 Date: Dec. 15, 1993

§ 102(e) Date: Dec. 15, 1993

[87] PCT Pub. No.: WO92/17675

PCT Pub. Date: Oct. 15, 1992

[51] Int. Cl.[7] ..... E04B 1/66

[52] U.S. Cl. ..... 277/644; 277/638; 277/648; 277/650; 52/717.03; 52/204.591

[58] Field of Search ..... 277/1, 205, 207 R, 277/227, 638, 644, 648, 650, 936, 944; 52/204.591, 717.05, 717.03

[56] References Cited

U.S. PATENT DOCUMENTS

| | | | |
|---|---|---|---|
| 3,076,777 | 2/1963 | Zeolla et al. | 524/525 |
| 3,388,517 | 6/1968 | Wohl et al. | 52/204.591 |
| 3,436,891 | 4/1969 | Church | 52/204.591 |
| 3,456,408 | 7/1969 | Zahn | 52/204.591 |
| 3,881,290 | 5/1975 | Bouchey | 52/204.591 |
| 4,409,283 | 10/1983 | Boyle, Jr. | 277/227 |
| 4,612,743 | 9/1986 | Salzer | 52/204.591 |
| 4,889,574 | 12/1989 | Furman | 52/204.591 |
| 4,939,879 | 7/1990 | Gold | 52/204.591 |

FOREIGN PATENT DOCUMENTS

| | | |
|---|---|---|
| 2636667 | 7/1970 | Australia . |
| 1684081 | 2/1970 | Germany . |
| 2420620 | 8/1975 | Germany . |
| 3706503 | 1/1988 | Germany . |
| 69178 | 4/1974 | Luxembourg . |
| 467926 | 2/1969 | Switzerland . |
| 113093 | 4/1968 | United Kingdom . |
| 1282531 | 2/1972 | United Kingdom . |
| 2209047 | 5/1989 | United Kingdom . |

*Primary Examiner*—Daniel G. DePumpo
*Attorney, Agent, or Firm*—Calfee, Halter & Griswold LLP

[57] ABSTRACT

A composite joint sealing gasket (8) includes an elongated flexible, resilient member (10) typically of an elastomer or polymer, for example, elastomer rubber, thermoplastic elastomer or thermoplastic polymer with memory, for example, EPDM or neoprene, and has opposed elongated upper and lower longitudinal edge portions (18, 16); the upper portion (18) defines a sealing element (40, 42); a tacky sealing composition (12), for example, a mastic composition is supported on an outer surface of the lower portion (16) remote from the sealing element (40, 42). The gasket (8) may be employed in a variety of environments where a seal is required, for example, between wall and ceiling panels, or as a glazing gasket to provide a seal with a window; when employed as a gasket the sealing element provides an outer seal with a window and the mastic composition provides an inner seal between the window and sash; streaking of the mastic composition across the window pane is avoided and the resilient member facilitates installation and provides an aesthetically pleasing appearance.

16 Claims, 4 Drawing Sheets

COMPOSITE GASKET

TECHNICAL FIELD

This invention relates to joint seal gaskets.

The sealing gaskets of the invention may be employed in a number of environments to provide a seal between joints, for example, to provide a seal between ceiling and wall panels, or as a glazing gasket to provide a seal between a window pane and an adjacent mounting structure.

The invention is particularly described by reference to glazing gaskets.

BACKGROUND ART

Glazing requirements have changed radically in recent years. In particular, modern commercial buildings and multi-dwelling buildings employ large glass panes and curtain walls.

The development of the curtain wall in the 1940's produced new requirements in glazing technology.

A curtain wall is essentially non-load bearing, carries its own weight, is usually hung from the super-structure and is subject to structural movement.

Glazing materials employed in such structures must be able to accommodate structural movements of mechanical origin developed by the wind, and thermal origin developed by expansion and contraction of the frame structure.

So-called "wet" glazing systems have been widely employed which comprise an elongated mass of tacky mastic material which is temporarily supported on an elongated strip of paper. The mastic material adheres to the window pane and to the window mounting structure and provides an effective, water-tight seal. On the other hand, the flowable nature of the mastic causes it to flow out onto the window pane in streaks, in response to structural movements which exert pressure on it. These streaks are unsightly and interfere with the clear view otherwise provided by the window pane.

In addition when streaking occurs on the outer window pane surfaces, rain washes the streaked mastic from the pane and onto the adjacent building structures, producing an overall deterioration in the appearance of the building.

More recently, so-called "dry" glazing has been developed which employs an extruded resilient is gasket, for example, a rubber gasket. These resilient gaskets do not exhibit streaking and produce a uniform edge around the pane which is more aesthetic in appearance than the edge produced by the mastic. The resilient gaskets are also easier to install.

Rubber gaskets provide a long-lasting weathertight seal but the sealing action is less effective than that of the mastic, which can flow into the surface irregularities of the frame structure. Consequently the "wet" glazing system has remained in wide spread use in spite of its inherent disadvantages.

DISCLOSURE OF THE INVENTION

The present invention seeks to provide a gasket which overcomes the disadvantages of the prior systems in the glazing field, but which is also suitable for non-glazing, joint sealing applications.

Essentially the present invention provides a composite joint sealing gasket comprising an elongated flexible, resilient member with opposed elongated upper and lower longitudinal edge portions. The upper portion has a resiliently deformable sealing element. A viscous, flowable, tacky sealing composition is supported on an outer surface of the lower portion remote from the sealing element.

The resilient member is, in particular, a self-supporting, shaped, extruded elastomer member of synthetic rubber or rubber-like material, for example, ethylene-propylene terpolymer (EPDM), neoprene (polychloroprene), styrene-butadiene rubber, nitrile rubbers and silicone rubbers. However, other polymer materials, for example, polyvinyl chloride may also be employed provided they have the requisite physical characteristics.

The flowable sealing composition may, for example, be a mastic composition of the type well known in the glazing field. Mastic compositions are tacky, self-adherent and flowable and will flow into surface irregularities producing a good seal. Mastic compositions adhere tenaciously to most surfaces, are of high viscosity and will flow under pressure if they are not physically confined.

The sealing composition is supported on the lower portion remote from the upper portion such that in use the flowable sealing composition does not migrate to the outer portion and exude beyond the sealing element.

DESCRIPTION OF PREFERRED EMBODIMENTS

In preferred embodiments the composite gasket includes a locking element extending outwardly of the resilient member, which in the case of a glazing gasket, is adapted to be held in a window frame structure to limit movement of the gasket relative to the structure.

In another preferred embodiment, in the case of a glazing gasket, the upper portion of the composite gasket has a catchment surface adapted to promote flow of water, for example, rain water, away from the window as well as maintaining a given face clearance.

In order to promote adhesion of the flowable joint sealing composition to the resilient member it is found to be advantageous to form a plurality of spaced apart, generally parallel serrations longitudinally of the resilient member. The serrations are separated by a plurality of parallel longitudinally extending ribs, whereby the surface area of the resilient member for contact with the flowable sealing composition is increased. In addition the presence of such serrations and ribs reduces the amount of material employed and also increases the flexibility of the resilient member.

Conveniently the composite gasket is provided with a release substrate, for example, a strip of paper, which is adhered to the sealing composition on one side of the gasket and is readily removable therefrom. In this way it is possible to wind a continuous length of the composite gasket into a roll.

In another aspect of the invention there is provided a method of making a composite joint sealing gasket comprising: advancing a continuous length of a flexible resilient member having opposed elongated longitudinal inner and outer edge portions, said outer edge portion defining a continuous, resiliently deformable sealing element on a first side of said member, feeding a tacky, viscous, flowable joint sealing composition onto said inner edge remote from said sealing element on at least said first side.

In a preferred embodiment the method includes a step of feeding a continuous release substrate into adhering engagement with the sealing composition on the first side to form the continuous composite joint sealing gasket.

BRIEF DESCRIPTION OF DRAWINGS

The invention is illustrated in particular and preferred embodiments by reference to the accompanying drawings in which.

MODES FOR CARRYING OUT THE INVENTION

Figure 1:
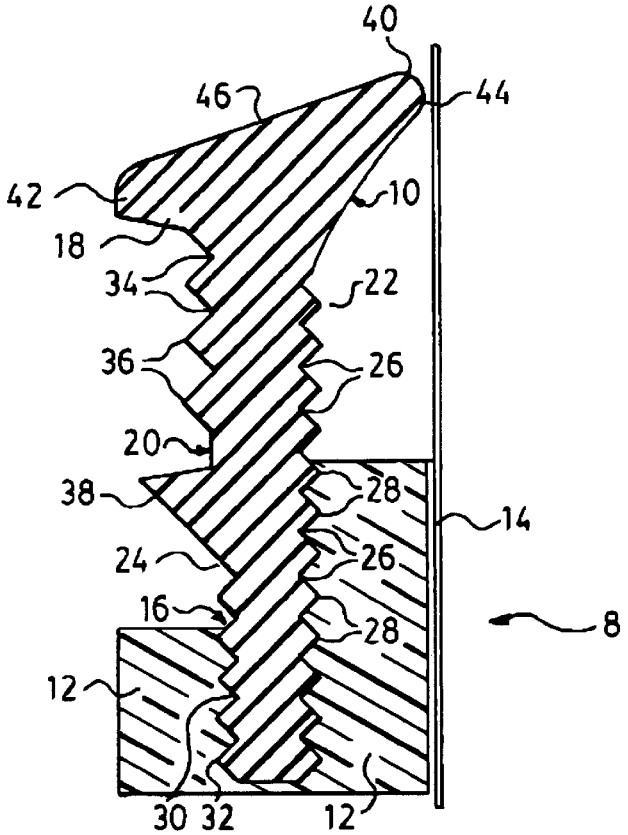
FIG. 1 is an end elevation in cross-section of a composite glazing gasket of the invention.

With further reference to FIG. 1, a composite gasket 8 includes an elongated extruded member 10, a mastic composition 12 and a release paper 14.

Extruded member 10 is in particular of flexible, resilient material, for example, a thermo-setting synthetic rubber. Mastic composition 12 is tacky, viscous and flowable.

Extruded member 10 includes an inner portion (lower) 16, an outer portion (upper) 18 and an intermediate portion 20 between portions 16 and 18, and includes a first side 22 adjacent release paper 14 and a second side 24 opposed thereto.

A plurality of longitudinal serrations 26 extend the length of member 10 on first side 22, on inner portion 16 and intermediate portion 20. Disposed between the serrations 26 is a plurality of spaced apart longitudinal ribs 28.

A similar plurality of longitudinal serrations 30 separated by longitudinal ribs 32 is disposed on second side 24 on inner portion 16; and a similar plurality of longitudinal serrations 34 separated by longitudinal ribs 36 is disposed on second side 24 on intermediate portion 20.

A deformable locking nib 38 extends from intermediate portion 20 adjacent inner portion 16 on second side 24.

Outer portion 18 includes an inner resiliently deformable sealing element 40 and an outer sealing element 42. Inner sealing element 40 includes a deformable sealing surface 44. Catchment surface 46 is defined between inner sealing element 40 and outer sealing element 42.

Figure 2:
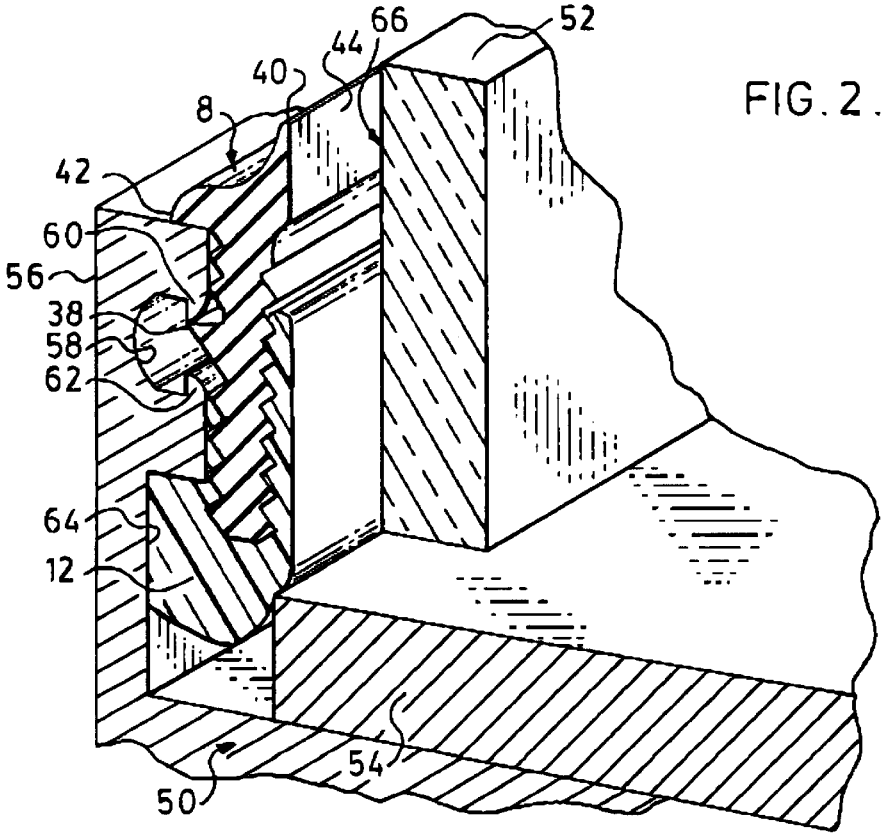
FIG. 2 shows the gasket of FIG. 1, in end elevation, in use between a window pane and a frame structure.

With further reference to FIG. 2, there is shown a structure 50 incorporating the composite gasket 8 of FIG. 1.

Structure 50 includes a window pane or lite 52 supported on a setting block 54 in a sash 56.

Sash 56 includes a race 58, an upper nib 60 and a lower nib 62. Cavity 64 is defined between sash 56 and window pane 52, below race 58. Window pane 52 has an outer window surface 66.

In use the composite gasket 8 is firmly located between window surface 66 and sash 56. The mastic composition 12 which extends on first and second sides 22 and 24 fills cavity 64 and adheres to window surface 66. Inner sealing element 40 is resiliently deformed against window surface 66, with sealing surface 44 being resiliently deformed against window surface 66. In this way catchment surface 46 is resiliently deformed to a generally concave configuration.

Outer sealing element 42 is disposed over and in engagement with sash 56. Locking nib 38 prevents movement of gasket 8 out of the space between sash 56 and window surface 66. In particular, as shown in FIG. 2, the locking nib 38 engages or will engage the upper nib 60 to prevent outward movement of the gasket 8.

The inner and outer sealing elements 40 and 42 respectively form outer seals to prevent entry of water between the sash 56 and the window surface 66. The catchment surface 46 provides flow of water, particularly rain, away from the window surface 66 over outer sealing element 42 and over sash 56.

The mastic composition 12 which extends on first and second sides 22 and 24 from inner portion 16 provides a tight inner seal between sash 56 and window surface 66, in the event that water passes the outer seal formed by outer portion 18.

The serrations 30 and 34 and the ribs 32 and 36 provide an enlarged surface area to better support the flowable mastic composition 12 on the extruded member 10.

The series of longitudinal serrations and ribs 26, 28 respectively, 30, 32 respectively and 34 and 36 respectively, also function to make the extruded member 10 more flexible, while at the same time reducing the amount of material employed.

Figure 3:
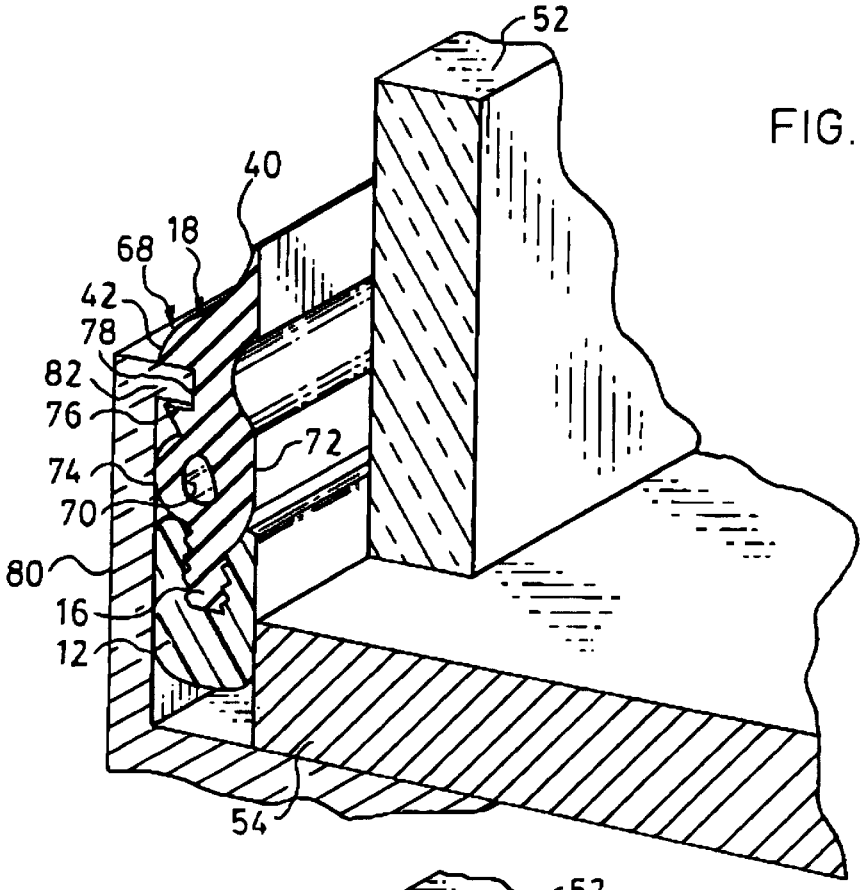
FIG. 3 is a view similar to FIG. 2, with a different gasket of the invention.
Figure 5:
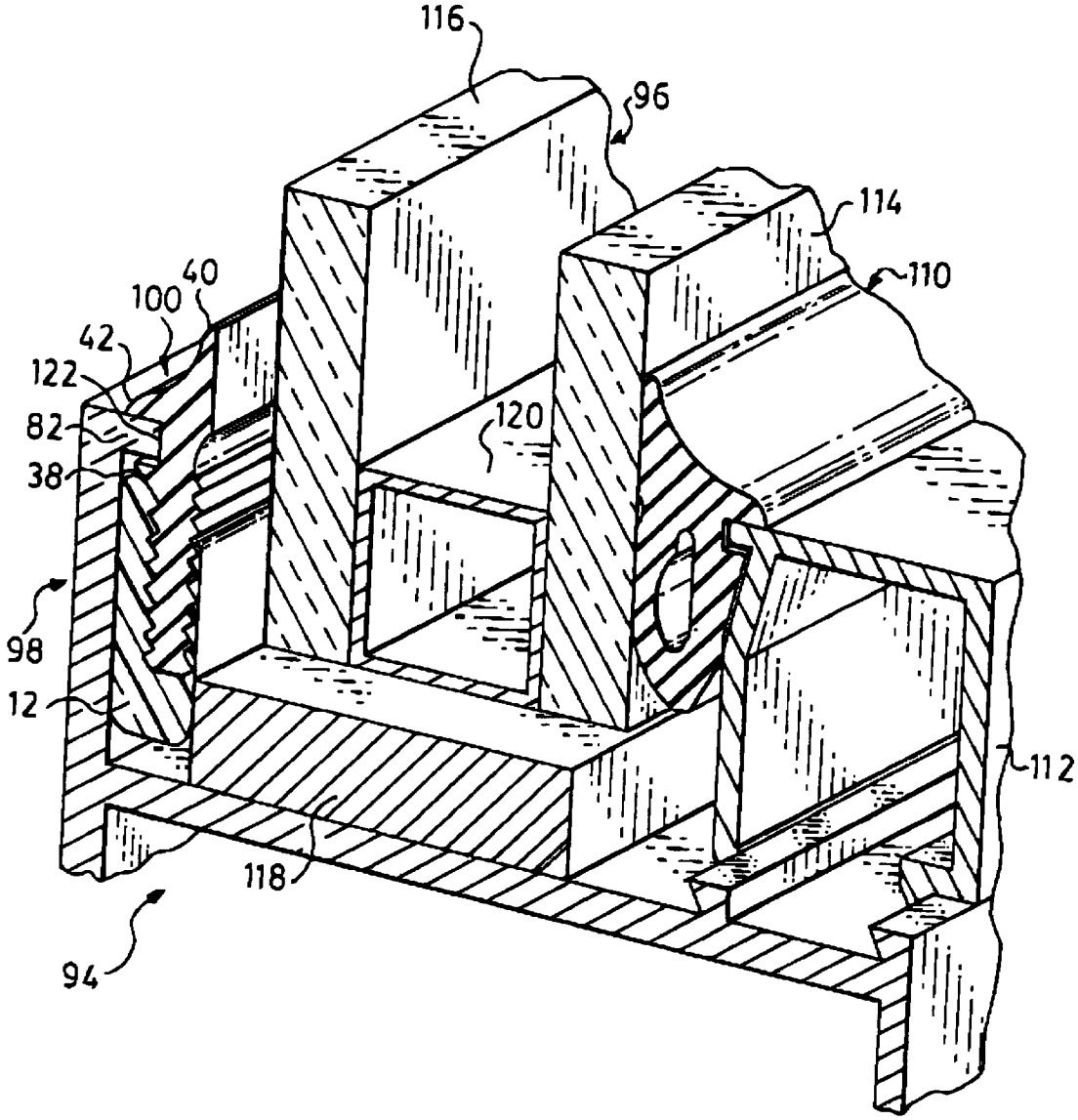
FIG. 5 is a side elevation in cross-section, part cut away showing yet another gasket of the invention, in conjunction with a conventional gasket.

FIGS. 3 and 5 show different embodiments of composite glazing gaskets of the invention, in their operative environments. A wide range of designs of composite glazing gaskets are contemplated by the present invention, and different designs are appropriate depending on the structure of the sash and race.

Figure 4:
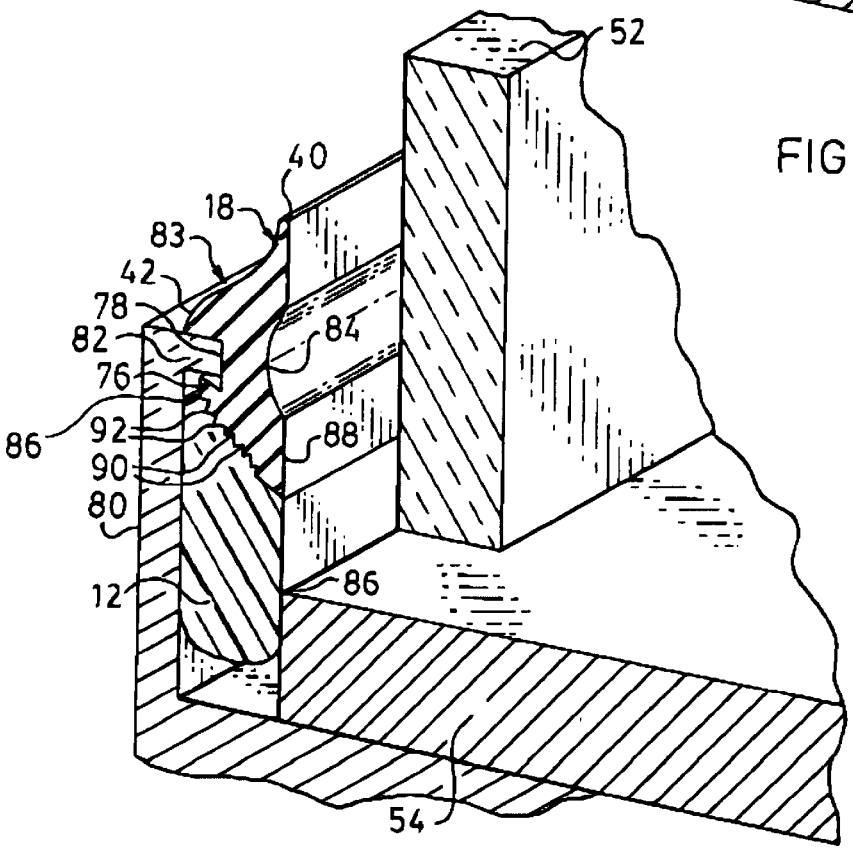
FIG. 4 is a view similar to FIG. 2, with still another gasket of the invention.

In FIGS. 3 to 5 the same numbers are employed where parts of the gasket are essentially the same as shown in FIG. 1.

With further reference to FIG. 3, a composite gasket 68 has an outer portion 18 and an inner portion 16 with a mastic composition 12 about inner portion 16.

The gasket 68 has a generally tubular body 70, intermediate inner portion 20 and outer portion 18. A recess 78 is defined between an outer sealing element 42 and a locking nib 76.

Tubular body 70 has a deformable inner face (glass side) 72 and a deformable outer face (sash side) 74.

Inner portion 16 has longitudinal serrations and ribs on its inner and outer sides similar to the gasket 8 of FIG. 1.

The sash 80 differs from that in FIG. 2 and particularly includes an arm 82 which projects into recess 78.

In use, inner sealing element 40 is deformed against window pane 52 as in the embodiment of FIG. 2. Outer sealing element 42 extends over arm 82 and forms a seal.

Mastic composition 12 forms a seal at sash 80 and window pane 52 and the deformable inner and outer faces 72 and 74 respectively likewise form seals with sash 80 and window pane 52 respectively.

Locking nib 76 prevents gasket 68 from emerging from between the sash 80 and window pane 52.

It will be seen that in this embodiment in addition to the outer and inner seals similar to those formed in the embodiment of FIG. 2, there is in addition formed an intermediate seal by means of tubular body 70.

With further reference to FIG. 4, a composite gasket 83 is employed in a structure corresponding to that of FIG. 3.

Gasket 83 has a first side 84 and a second side 86. A deformable face 88 is formed on first side 84 and a plurality of spaced apart longitudinal serrations 90 and longitudinal ribs 92 are formed on second side 86.

Gasket 83 has a recess 78 and locking nib 76 similar to those of gasket 68 in FIG. 3. The outer portion 18 of gasket 83 has an inner sealing element 40 and an outer sealing element 42 similar to those in FIGS. 1 to 3.

Gasket 83 is secured between sash 80 and window pane 52 in a manner essentially similar to that described and illustrated in FIG. 3, with arm 82 received in recess 78.

Outer seals are formed by sealing elements 40 and 42 as in FIGS. 2 and 3 and an inner seal is formed by mastic composition 12 engaging the window pane 52 and the sash 80 as in FIGS. 2 and 3.

In addition an intermediate seal is formed by face 88 which is deformed into a sealing contact with window pane 52.

With further reference to FIG. 5, there is shown an assembly 94 including a window 96, a sash 98, a composite gasket 100, a wedge gasket 110 and a stop 112.

Window 96 includes an inner pane 114 and an outer pane 116 supported on a setting block 118 and separated by a spacer 120.

Composite gasket 100 is similar to composite gasket 8 of FIGS. 1 and 2 but differs in having a recess 122 between outer sealing element 42 and locking nib 38. It will be noted that the sash 98 is similar to that of FIGS. 3 and 4 and thus differs from that of FIG. 2. Sash 98 thus includes an arm 82 which is received in recess 122.

Inner and outer seals are formed as for the embodiment of FIG. 2 and the locking nib 38 functions to prevent the gasket 100 exiting from between the sash 98 and window 96.

The embodiments of FIGS. 2 and 5 have been particularly described by reference to the case in which the composite gasket is disposed between an outwardly facing face of a window pane and a sash. Thus, in the embodiment of FIG. 5 the composite gasket 100 is disposed on the exterior of the building and the conventional wedge gasket 110 is disposed on the interior. The composite gasket can also be disposed against the interior face of window 96.

Whether the composite gasket is disposed on an interior face or an exterior face is somewhat dependent on the manner of assembly of the window pane in the structure. If the window pane is inserted from the outside of the structure, then for simplicity of assembly the composite gasket will be located on the inside. On the other hand, if the glass is inserted from the inside of the structure, the composite gasket will be on the outside of the structure. Either way an effective seal is provided by the composite gasket of the invention, which prevents exit and entry of air around the window, as well as preventing entry of water into the building. For the purposes of preventing entry of water it is preferable to have the composite gasket on the external face of the window since in this way entry of water is prevented not only to the interior but also between the external parts of the window pane and sash of the window assembly.

Figure 6:
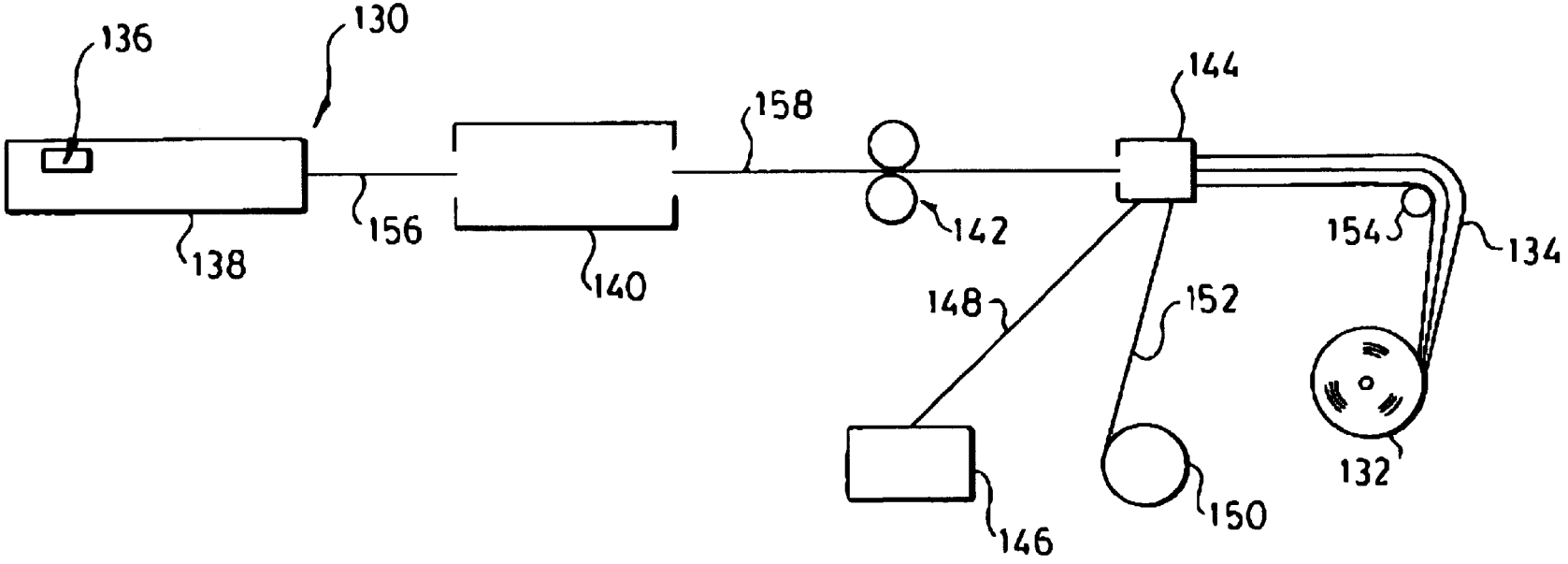
FIG. 6 illustrates schematically an apparatus and process for producing a gasket of the invention.

With further reference to FIG. 6 there is illustrated schematically an apparatus 130 for producing a roll 132 of a composite rubber gasket 134 in accordance with the invention.

Apparatus 130 includes a feed throat 136 for rubber screw extruder 138, curing chamber 140, draw rollers 142 and a die 144.

A source 146 of mastic composition communicates via a line 148 with die 144; and a roll 150 provides a source of release paper 152.

A roller 154 completes the assembly.

In operation a rubber composition in elongated strip form is fed through feed throat 136 into extruder 138 to form a continuous rubber extrusion 156.

Rubber extrusion 156 is advanced by means of draw rollers 142 through curing chamber 140 to effect cure to a shaped member 158 and is fed through a die 144, the shape of member 158 being predetermined having regard to the intended use.

Mastic composition is fed from source 146 along line 148 into one side of die 144 where it surrounds one longitudinal edge of the advancing shaped rubber member 158.

Release paper 152 is fed from roll 154 to die 144 and is adhered to the mastic composition on one side of the advancing rubber member 158 to form composite glazing gasket 134.

The advancing gasket 134 is fed over roller 154 to form a roll 132 of continuous composite glazing gasket.

The form of curing member 140 is dependent on the nature of the rubber composition. It may, for example, be a hot air curing chamber or a hot molten salt bath.

In use lengths of gasket 134 are cut from roll 132 in desired lengths.

As indicated above the tacky mastic composition may be any of the conventional mastic compositions employed in the glazing field. By way of example the mastic composition may be based on a mixture of butyl rubber and polybutene. Mastic compositions of this general type are desired in U.S. Pat. 3,076,777. The mastic composition will typically be free of vulcanizing or curing agents, however, it is also envisaged that the mastic composition may contain vulcanizing or curing agents sufficient to effect an at least partial cure. This at least partial cure would render the mastic composition less flowable but it would still be mobile or moldable under pressure encountered in installation.

The mixture of butyl rubber and polybutene may suitably contain carbon black in an amount to increase the tensile strength of the mixture as well as calcium carbonate which functions as a filler but also increases the tensile strength.

While the invention has been described and illustrated for the particular embodiment in which the composite gasket is a glazing gasket it will be understood that the invention is applicable to joint sealing gaskets generally.

We claim:

1. A composite joint composite joint gasket comprising:

an elongated flexible, resilient member having an upper elongate longitudinal, terminal edge portion and a lower elongate longitudinal terminal, edge portion, said lower terminal portion having an outer surface remote from said upper elongate longitudinal, terminal edge portion, a resiliently deformable sealing element defined in said upper terminal edge portion, and a tacky viscous, flowable joint sealing composition supported on said outer surface of said lower terminal edge portion, such that said sealing composition is remote from said sealing element, and migration of said sealing composition to said sealing element and beyond during use, is avoided, said sealing composition at its closest position to said upper elongate longitudinal, terminal edge portion being spaced from said upper edge portion at least half the distance between the upper edge portion and the lower edge portion, said sealing element and at least a portion of said joint sealing composition being disposed on a first side of said resilient member and further including a release substrate on said first side, removably adhered to said sealing composition.

2. A gasket according to claim 1, wherein said sealing composition is a glazing composition.

3. A gasket according to claim 2, wherein said sealing element has a sealing surface in facing relationship with said release substrate, said sealing surface being adapted to be resiliently deformed into sealing engagement with a window pane.

4. A gasket according to claim 3, wherein said upper portion has a catchment surface adapted to promote flow of water away from said sealing surface.

5. A gasket according to claim 2, wherein said resilient member includes a second side opposite to said first side, and further including a locking element extending outwardly of said resilient member at said second side, intermediate said upper portion and said lower portion, said locking element being adapted to be held in a window frame structure to limit movement of said gasket relative to said structure.

6. A gasket according to claim 1, wherein said lower portion has at least one protuberance adapted to promote adhesion of said sealing composition to said outer surface.

7. A gasket according to claim 6, wherein said at least one protuberance comprises a plurality of generally parallel ribs.

8. A gasket according to claim 2, wherein said resilient member includes a second side opposite to said first side, and further including a locking element extending outwardly of said resilient member at said second side, intermediate said upper and lower portions, said locking element being adapted to be held in a window frame structure to limit movement of said gasket relative to said structure, and said lower portion has at least one protuberance adapted to promote adhesion of said glazing composition to said lower portion.

9. A gasket according to claim 4, wherein said resilient member includes a second side opposite to said first side, and said upper portion includes a second sealing element on said second side adapted to sealingly engage a window sash.

10. A gasket according to claim 1, wherein said resilient member is of extruded, shaped elastomer and said sealing composition is a mastic composition.

11. A method of making a composite joint sealing gasket comprising:

advancing a continuous length of a flexible resilient member having an elongated longitudinal inner terminal edge portion and an elongated longitudinal outer terminal edge portion, said outer terminal edge portion defining a continuous, resiliently deformable sealing element on a first side of said member; and feeding a tacky, viscous, flowable joint sealing composition onto said inner edge portion remote from said sealing element on at least said first side to form a continuous composite joint sealing gasket, said sealing composition at its closest position to said elongated longitudinal outer terminal edge portion being spaced from said outer terminal edge portion at least half the distance between the outer terminal edge portion and the inner edge portion such that said sealing composition is remote from said sealing element, and migration of said sealing composition to said sealing element and beyond during use, is avoided.

12. A method according to claim 11, further including feeding a continuous release substrate into adhering engagement with said joint sealing composition on said first side.

13. A method according to claim 11, including winding said continuous gasket to form a roll.

14. A method according to claim 11, including a step of continuously extruding said resilient member in a predetermined shape.

15. A method according to claim 13, including a step of continuously extruding said resilient member in a predetermined shape.

16. A method according to claim 11, wherein said joint sealing composition is a glazing composition.

* * * * *